US008850619B2

(12) United States Patent
Rush et al.

(10) Patent No.: US 8,850,619 B2
(45) Date of Patent: Oct. 7, 2014

(54) TECHNICAL GARMENT

(76) Inventors: Josh Rush, Torquay (AU); Troy Brooks, Torquay (AU)

( * ) Notice: Subject to any disclaimer, the term of this patent is extended or adjusted under 35 U.S.C. 154(b) by 361 days.

(21) Appl. No.: 13/035,808

(22) Filed: Feb. 25, 2011

(65) Prior Publication Data

US 2011/0209267 A1 Sep. 1, 2011

(30) Foreign Application Priority Data

Feb. 26, 2010 (AU) ..... 2010900819
Sep. 24, 2010 (AU) ..... 2010904325

(51) Int. Cl.
*A41D 13/02* (2006.01)
*A41D 7/00* (2006.01)
*A41D 1/08* (2006.01)

(52) U.S. Cl.
CPC ..... *A41D 7/005* (2013.01); *A41D 2600/10* (2013.01); *A41B 2400/38* (2013.01); *A41D 2300/33* (2013.01); *A41D 1/08* (2013.01)
USPC ..... 2/228; 2/23; 2/79

(58) Field of Classification Search
USPC ..... 2/227, 228, 67, 69, 79, 23, 78.3, 231, 2/238, 248, 400
See application file for complete search history.

(56) References Cited

U.S. PATENT DOCUMENTS

| | | | | |
|---|---|---|---|---|
| 2,034,312 | A * | 3/1936 | Rubin | 2/228 |
| 3,246,650 | A * | 4/1966 | Wells | 450/104 |
| 5,367,708 | A * | 11/1994 | Fujimoto | 2/22 |
| 5,598,586 | A * | 2/1997 | Munjone | 2/237 |
| 5,887,453 | A | 3/1999 | Woods | |
| 6,874,337 | B2 * | 4/2005 | Uno et al. | 66/177 |
| 6,886,182 | B2 | 5/2005 | Saillet et al. | |
| 7,087,032 | B1 * | 8/2006 | Ikeda | 602/19 |
| 7,631,367 | B2 | 12/2009 | Caillibotte et al. | |
| 2004/0111781 | A1 | 6/2004 | Miyake et al. | |
| 2004/0255358 | A1 * | 12/2004 | Ota et al. | 2/69 |
| 2007/0022510 | A1 | 2/2007 | Chapuis et al. | |
| 2007/0256207 | A1 | 11/2007 | Roux | |
| 2010/0043114 | A1 | 2/2010 | Caillibotte et al. | |
| 2011/0000005 | A1 | 1/2011 | Brown | |
| 2012/0117714 | A1 * | 5/2012 | Peck et al. | 2/228 |

FOREIGN PATENT DOCUMENTS

| | | |
|---|---|---|
| EP | 1747731 | 1/2007 |
| EP | 1980165 | 10/2008 |
| EP | 1563748 | 11/2008 |

* cited by examiner

*Primary Examiner* — Katherine Moran
(74) *Attorney, Agent, or Firm* — Snell & Wilmer LLP

(57) ABSTRACT

A technical pant garment 10 having an inner short 11 and an outer short 12. The inner short 11 is formed to tightly fit a wearer of the garment 10 and the outer short 12 is connected to the inner short 11 to fit loosely about the inner short 11. The inner short 11 is constructed to impose on or more leads on the wearer which act to affect the posture of the wearer in a manner tending to cause the wearer who has adopted an incorrect posture to realign towards a correct posture.

20 Claims, 6 Drawing Sheets

TECHNICAL GARMENT

CROSS-REFERENCE TO RELATED APPLICATIONS

This application claims the benefit and priority under 35 U.S.C. §119(a) to Application No. 2010-904325 filed in Australia on Sep. 24, 2010 and Application No. 2010-900819 filed in Australia on Feb. 26, 2010, the entire contents of each of these patent applications are hereby expressly incorporated by reference herein.

FIELD OF THE INVENTION

The present invention relates to a technical garment which has been developed principally for use in the surfing industry by surfboard riders. It will be convenient to describe the invention in that context, but it should be appreciated that the invention would have wider application, such as to other sports including wake boarding.

BACKGROUND OF THE INVENTION

Surfboard riders (hereinafter "surfers") surfing in cold waters typically wear a wetsuit in order to prolong the period in which the surfer can remain in the water. In warmer water, surfers often wear shorts, typically known as "boardshorts", as protection from the cold is not necessary and shorts provide the surfer with a greater freedom of movement compared to a wetsuit.

A typical style of boardshort is loose-fitting and extends to a length which is either just above or below the knee. A standard form of boardshort consists of a polyester based fabric which is lightweight and substantially or fully water repellent. The leg length is usually in the region of 110 cm or 22 inches, while the boardshort consists usually of two or four major panels that are joined such as by stitching, at the centre of the short and at the inseams.

Because boardshorts are typically loose-fitting, this can result in skin chafing caused by friction between the loose fabric of the boardshort and the skin of the surfer, most often when the fabric is wet, i.e., during surfing. Moreover, because of the loose-fit of a typical boardshort, the fabric can also catch the knees of the surfer, particularly when the surfer moves on the surfboard from a crouched position to a standing position. Such knee catching is uncomfortable to the surfer and increases the number of accidents or "wipeouts" in the surf.

Boardshorts are principally a fashion item, as they do not provide a performance advantage to surfers over briefer or less bulky swimwear. However the acceptance of boardshorts in the surfing community is substantial despite the restrictions that boardshorts impose on the wearer and therefore manufacturers of boardshorts have attempted in the past to make improvements to boardshorts to alleviate the disadvantages.

Developments in boardshorts in recent times have therefore been made principally in relation to the fabric of the shorts with the adoption of stretch fabrics, which, although still tending to grip the skin of the surfer, stretch, thus imposing less restriction on surfer movement. The use of such stretch fabrics has also been linked to a reduction in chafing and other irritations and thus an increase in the comfort level of the boardshort during surfing. Other boardshort developments have been to slightly shorten the standard length of the boardshort and to alter the construction of the short so that the inseam has been replaced in some forms of boardshorts with an outseam, reducing seam contact and thus potential irritation with the inner leg of the surfer.

As an example of one development in boardshort construction, U.S. Pat. No. 7,849,518 in the name of Hurley International, LLC, describes an improved pair of water shorts which employ a pair of woven textile portions that have different positions in the short and which have different levels of stretch. The construction of the water short is described as being able to stretch to conform with movement of a wearer, thus providing less restriction and a greater freedom of movement during activity.

The present applicant recognises that the use of stretch fabrics can reduce restriction to movement and can thus provide an increase of the comfort of the wearer and also a potential increase in performance by a reduction in accidents or wipeouts in the surf. However, the present invention has been developed with a greater emphasis on performance rather than comfort, noting that the developments to boardshorts to date have been made in respect of reducing the negative aspects of boardshorts, rather than addressing new developments that target performance not available in current boardshorts.

Thus, a garment according to the invention is considered to be a "technical" garment which aims to improve the performance of a wearer of the garment, such as a surfer during surfing. Flexibility, balance and importantly, muscle strength, all play a significant part in the sport of surfing, while the ability to complete surfing manoeuvres relies heavily on the surfer's technique and control. However, the great majority of surfers do not have correct technique or have developed what would be considered to be bad surfing habits. This has the effect of slowing improvement and limiting performance and normally requires correction through coaching. It also puts such surfers at a higher possible risk of injury in the water.

SUMMARY OF THE INVENTION

The present invention provides a technical pant garment having an inner short and an outer short, the inner short being formed to fit tightly to the wearer and the outer short being connected to the inner short and fitting loosely about the inner short, the inner short being constructed to impose one or more loads on the wearer which act to affect the posture of the wearer in a manner tending to cause a wearer who has adopted an incorrect posture to realign towards a correct posture.

The garment according to the invention is principally for use by surfers or in other sports in which a stance similar to that adopted in surfing is also adopted. The garment according to the invention is intended to affect the stance or posture of the wearer to improve the stance or posture for the activity that is being undertaken. The garment may be arranged to have an effect only when the wearer adopts a poor or incorrect stance or posture, or it can continuously apply a load regardless of whether the stance or posture that has been adopted is correct or incorrect.

In garments according to the invention, the inner short can include sections of resistance which are positioned to resist movement of the wearer in certain directions. Alternatively, the inner short can include tensioned sections that are positioned to push or pull against the skin of the wearer. In either case, the sections are intended to cause the wearer to shift or move or realign into a position that is a better position for the activity that is being undertaken, ie surfing. The inner short can in some embodiments be considered to be a structural short which has structural sections, or supporting sections, which provide a structure or support to the garment. By that structure or support, the load applied to affect the posture of the wearer movement is provided.

A garment according to the invention is intended to realign the wearer in a direction to promote good function and form in a particular sport. For surfing, the garment is intended to have an effect in one or more of the following areas:

alignment of the knees to maintain them at an appropriate spacing;

opening the hips/pelvis;

supporting the thigh muscles;

encouraging a stronger, more stable stance; and/or increasing the efficiency and power output of the legs.

A garment according to the invention can promote proper stance and positioning of a surfer on a surfboard which can lead to better muscle performance because the leg muscles are also then properly positioned. The surfer can also have better flex and cleaner movement on the surfboard so that the surfer is then better able perform surfing manoeuvres.

In some forms of a garment according to the invention, the wearer will feel negligible load influence from the garment when the correct or proper stance has been adopted. As the wearer shifts away from the correct or proper stance, the wearer will feel a gradual increase in the load influence from the garment, so that the wearer will be aware of his or her shift away from the correct or proper stance. That feeling of an increasing load influence will indicate to the wearer that a return to or realignment to the correct or proper stance is required, while a return to that stance will be accompanied by a reduction, gradual or immediate, in the load influence felt by the wearer from the garment. The wearer thus receives feedback from the garment in response to the stance the wearer adopts.

In some forms of a garment according to the invention, the increase in the load influence from the garment will not be gradual, but rather, it will be more immediate, abrupt or sudden. Thus, in these forms of the invention, the wearer is given a relatively immediate indication that he or she has shifted away from the correct or proper stance so that realignment is required. This can be achieved in some forms of the invention by the use of relatively rigid sections of resistance that impose substantially maximum resistance immediately once the surfer has shifted away from the correct or proper stance.

In other forms of a garment according to the invention, a mixture of gradual and abrupt increases in load influence can be incorporated into the garment as required.

In other forms of the garment the load influence applied can be maintained even though the wearer is in the correct stance or posture, so that the influence is constant and always acting. Thus, the garment can apply a pull load for example, which constantly pulls at the skin or muscles of the wearer so that there is a constant pull at all times the wearer wears the garment, tending to align the wearer at all times into a correct or proper stance.

The inner short can be made out of any suitable material, and while the material can be inelastic and tight fitting, elastic materials have been preferred to date. Suitable elastic materials include those known as LYCRA® or "spandex". In some forms of a garment according to the invention, the inner short can be compression short to apply muscle compression to the wearer. The provision of muscle compression can promote improved blood flow within the muscles, reduced muscle damage, reduced muscle fatigue and improved recovery. This can potentially assist a surfer to surf for longer before fatigue sets in.

The construction of the inner short can include broad panels that form one or more sections of a garment according to the invention and which impose suitable loads on the wearer. A plurality of panels can be employed with differing load characteristics. Alternatively, the construction of the inner short can include elongate banding or taping (hereinafter "taping") which likewise impose suitable loads on the wearer. Still alternatively, a combination of broad panels and elongate taping can be employed.

The panels and taping can be of any suitable shape. Thus, the panels can be of regular shape, square or oval for example, or more likely, of irregular shape.

The taping can also be of any suitable shape and length and it can follow any suitable path. The width of the taping can therefore vary as can the direction it follows and the load it applies. The taping can also be formed in a pattern such as a grid or chequered pattern to provide a constant load across a selected area of the inner short. Different shapes or styles of taping can be applied to different areas of the inner short. For example, elongate taping can be applied in addition to grid or chequered taping.

The construction of the inner short can be arranged to impose variable loads so as to provide greater load in some portions of the garment than in other portions. This arrangement might be employed to ensure that preference is given to the most important posture correction or realignment. It might also be employed so that as the wearer initially moves away from a correct or proper stance a lower load is felt in one part of the wearer's body (the wearer's hips for example) but if the stance is not corrected and further movement away from the correct or proper stance occurs, a greater load is applied, perhaps in the same body area or in a different area, further emphasising or indicating to the wearer the departure of the wearer from the correct or proper stance. Thus, the applied load can be graduated in the level it is applied.

Variation in the load applied by the inner short can be provided in any suitable manner. In some forms, the thickness of any panels or taping can be varied. In other forms, the density of the weave of the panels or taping, or the density of stitching employed can be varied. Still alternatively, the wall thickness of the panels or taping can vary.

Garments according to the invention are particularly suitable for customisation, so that the load applied through the inner short and the direction of application can be selected based on individual requirements. A customer could for example, be measured or assessed prior to creation of the inner short to assess what load characteristics the inner short should have.

Where the garment includes panels, the panels can have any suitable construction and can be made from any suitable material. Plastic panels could be employed, as can neoprene, rubber, polyurethane or silicon panels, or any other suitable material.

The elongate taping can be applied to the outer surface of the inner short or to the inner surface, or to both the inner and the outer surface. Thus, the inner short can have the taping applied to the surface of the inner short such as by adhesive, stitching/sewing, heat fusion or other suitable attachment mechanism. The taping alternatively can be applied by printing, such as a rubberised or plasticised polyurethane ink that is printed onto the inner or outer surface of the inner short. Other print products could also be employed such as silicon print. The taping could comprise a thermoplastic elastomer, such as styrenic block copolymers, polyolefin blends, elastomeric alloys, thermoplastic polyurethanes, thermoplastic copolyester and thermoplastic polyamides. These forms of taping can be heat fused, printed or adhered to the surface of the short. Alternatively, the taping can form a connection between adjacent panels of a garment, similar to a seam.

The inner short can alternatively be formed of one material and load application and variation can be provided by high density stitching in relevant areas. The stitching can form elongate bands similar to taping. The stitching can be overlaid by a material which is operable to grip the skin of the wearer to enhance the application of load between the inner short and the wearer. A thermoplastic elastomer, rubber or silicon material could be used for that purpose, while other suitable materials are discussed below.

The inner short can include materials to grip the skin of the wearer to enhance the application of load between the inner short and the wearer. The taping can have this function or other materials can be employed. For example, the inner surface of the inner short can include an adhesive or a tacky material such as silicon to grip the wearer's skin. This type of material can be applied as an elongate tape or band, or it can be applied at discrete points, such as a series of dots or discs, or other suitable shaped portions. The material might for example be applied as a series of arrows to indicate the direction of the load on the wearer. A material to grip the skin can be applied across the entire surface of the inner short, either as an uninterrupted layer, or as a pattern, such as a series of dots or discs, or it can be applied just to sections of the inner short at which sections gripping of the skin is necessary.

As indicated, the taping can be selected to grip the skin of the wearer. The taping can thus be applied to the inner surface of the inner short, or facing the skin over which the inner short is to be applied. The taping can be applied in a matrix, grid or chequered form over a wide surface area of the inner short, to provide a wide area of grip. That matrix, grid or chequered form of taping can be in addition to elongate taping. In some forms of the invention, the elongate taping can apply the major load for the purpose of tending to cause a wearer who has adopted an incorrect posture to realign towards a correct posture, while the taping having a matrix, grid or chequered form can provide the major grip of the inner short to maintain the inner short in the position it is intended to be worn for maximum benefit.

The taping can be of any suitable thickness or width across the surface of the inner short and for example, a width of about 50 mm or less can be employed. However, greater or lesser widths can be employed. For example, the width might be 60 or 70 mm or greater, or from 5 mm to 50 mm if it is reduced. The taping might taper throughout its length and it might intersect with other taping sections. The taping can be of constant width or it can vary in width along its length. The inner short can include a plurality of taping sections and these can be of the same width or they can be different. Some taping sections can overly other taping sections. For example, a section of taping that is formed in a grid or matrix form can be overlaid by and elongate section that crosses the grid or matrix.

In some forms of the invention, the taping includes sections that extend from the waist section of the inner short to or towards the leg ends of the inner short. The taping can comprise or include sections that extend laterally to the sections that extend from the waist section of the inner short to or towards the leg ends of the inner short. The respective sections can intersect. The sections that extend from the waist section of the inner short to or towards the leg ends of the inner short can be curved.

The taping might in some forms include a section that extends from the waist section downwardly towards the leg ends and that extends in a curve or an arc. In some forms, that section will be located in a side region of the inner short, on each side of the inner short and be concave as viewed from the rear of the inner short. The end of the section at the leg end of the inner short might terminate towards the middle of the rear of the leg end of the inner short as viewed from the rear of the inner short. The end of the section at the leg end of the inner short might terminate in connection with a taping section that forms a ring about the leg end of the inner short.

The taping can be applied to both the rear and the front of the inner short. Taping that commences on one of the front or rear of the inner short can extend to the other of the front or rear of the inner short. The taping can form boundaries about sections of the inner short within which other taping can be inserted. For example, taping in the form of the matrix or grid type taping can be disposed in sections of the inner short bounded by elongate taping. The matrix or grid type taping can be formed from relatively thin tape section while the elongate taping can be formed from wider taping.

Flexible or substantially rigid portions of panels or taping can be employed. Flexible materials include thermoplastic elastomers, polymers, fabrics such as neoprene, rubbers, printed inks or printed silicon and some plastics, resins, adhesives and stitching. Rigid materials include some plastics, resins and adhesives, rubbers and metals. The inner short can include a more rigid or solid panel or taping from which other panels or taping extend and to which those panels or taping pull towards in applying loads to the wearer. In other words, the more rigid or solid panels or taping assist to react the load applied to the wearer.

The outer short can also be made from any suitable material, such as has been employed in the past, ie polyester based fabrics. The connection between the inner short and the outer short can be in any suitable manner such as by stitching/sewing, hook and loop (VELCRO®) fastener, mesh connection whereby the mesh forms a bridge between the inner short and the outer short, or by adhesive. The outer short can have the construction of an existing short subject to providing room within the short for the inner short. Thus, the outer short could thus have a draw-string, VELCRO®, elasticised or button waist and can include pockets and key loops etc.

The outer short can, in terms of standard clothing sizes, be of a greater size than the inner short. For example, the outer short can be a single size larger than the inner short so that the inner short could be a size 30 and the outer short could be a size 32. The advantage of this arrangement is that it enables standard sizes to be employed for the inner and outer shorts, rather than necessitating custom sized shorts. In this arrangement, the inner and outer shorts can be connected by a mesh which is approximately dimensioned to take up the size difference between the inner and outer shorts.

The outer short and the inner short can extend to about the same length between the waist and the knees of a wearer. This has the benefit of substantially obscuring the inner short from view, so that the outer short remains the major part of the garment which is visible. However, the inner short can be visible if desired, such as a top portion of the inner short being visible over the top of the outer short. This visible portion of the inner short might be only a small portion of 1 cm or 2 cm. This can contribute to identifying the performance characteristics of the garment, by making the inner short slightly visible.

The outer and inner short can be connected in any suitable manner. The inner short can include an elastic waist, which assists to maintain the inner short in the intended position against the skin of the wearer. The portion of the outer short adjacent the elastic waist can be non-elastic, and can thus have an appearance of prior art boardshorts, which typically have a non-elastic waist.

A garment according to the invention also can advantageously maintain the look of a current form of boardshort by the use of the loose outer short. Thus, while the garment according to the invention provides the advantages described above, the garment is not aesthetically a major departure from what exists already. This is important in the surfing industry in which product look plays an important role.

For a better understanding of the invention and to show how it may be performed, embodiments thereof will now be described, by way of non-limiting example only, with reference to the accompanying drawings.

DETAILED DESCRIPTION

Figure 1B:
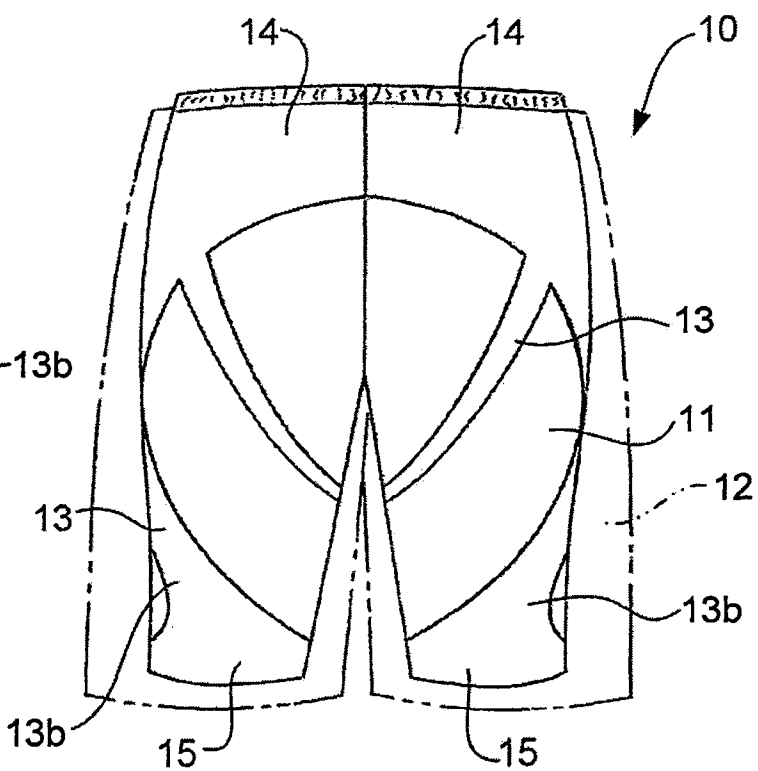
FIG. 1 illustrates front and rear views of a technical pant boardshort garment according to an embodiment of the invention.
Figure 1A:
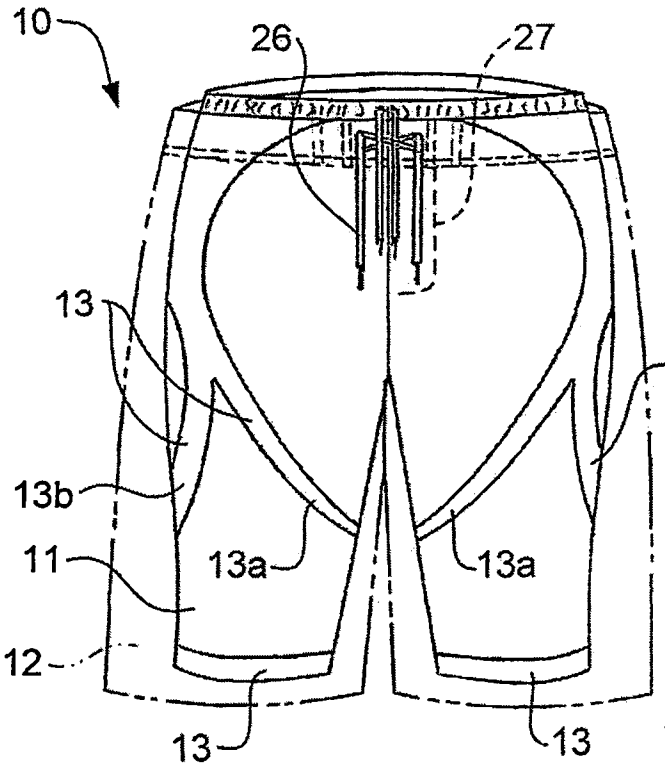

Referring first to FIG. 1, front and rear illustrations of a technical pant garment 10 (hereinafter "boardshort 10") in accordance with one embodiment of the invention are shown.

The boardshort 10 comprises an inner short 11 and an outer short 12. The inner short 11 is, intended to fit tightly about the waist and thighs of a person wearing the boardshort 10, while the inner short 11 is intended to extend from the waist region of a wearer to a region just at, above or below the wearer's knees. The inner short 11 can be made of an elastic material such as LYCRA ® or like material, and it can be a compression material to impart the benefits of muscle compression as previously described. Alternatively, the inner short 11 can be formed of an inelastic material.

The outer short 12 can be formed in any suitable manner and can be made of materials that are commonly used in boardshort manufacture already. Accordingly, the outer short 12 can be formed of substantially water repellent polyester fabric or any other suitable fabric.

It is intended, and it is evident from FIG. 1, that the outer short is a loose fit about the inner short 11, particularly at the bottom or knee-end of the inner short 11. Thus, the closeness of fit between the inner and outer shorts 11 and 12 is widest at the bottom end of the boardshort 10 and is closest at the waist end of the boardshort.

The boardshort 10 includes taping or banding 13 (hereinafter "taping 13"), which is shown extending about the front and rear of the boardshort 10. For the purposes of illustration, the taping 13 is shown applied to the outer surface of the inner short 11, but it is to be appreciated that it would normally be applied to the inner surface of the inner short 11, although it could also be applied to each of the inner and outer surfaces of the inner short 11. In the FIG. 1 embodiment, the taping 13 is sewn to the inner short.

As is apparent from FIG. 1, the taping 13 is elongate, but of varying shape. The taping 13*a* which extends from an outer side of the inner short 11 through to the inside leg of the short 11 decreases in width towards the inner leg. Moreover, the taping 13*b* increases in width as it extends from the front of the inner short 11 to the back of the short 11.

The back view of the boardshort 10 in FIG. 1 illustrates broad panels 14, while the same view also illustrates further panels 15. It is evident that the panels 14, 15 have a different shape to the taping 13, as the panels 14, 15 have a broader shape or surface area than the elongate taping 13. Each of the taping 13 and the panels 14, 15 is formed from the same material, such as neoprene, however, the size and shape of the panels 14, 15 provides those panels with more rigidity or stiffness than the more slender taping 13. The arrangement is such that the taping 13 tends to pull towards the panels 14, 15 in applying loads to the wearer. Thus, the panels 14, 15 assist to react the load applied to the wearer by the taping 13 because of their increased rigidity or stiffness.

The taping 13 principally, but also the panels 14, 15, are intended to impose loads on the waist and thighs of the wearer in order to affect the posture of a wearer to improve the posture in a surfing or like environment. Later figures will show the direction of loading which is applied, but before turning to those figures, reference will be made to FIG. 2 which shows an alternative arrangement in which the taping is applied by printing.

Figure 2B:
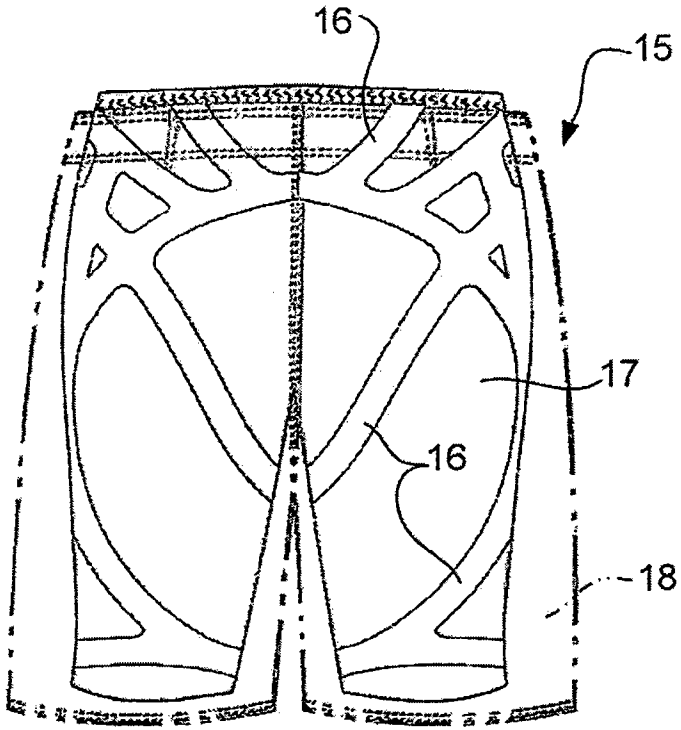
FIG. 2 illustrates front and rear views of an alternative technical pant boardshort garment according to an embodiment of the invention.
Figure 2A:
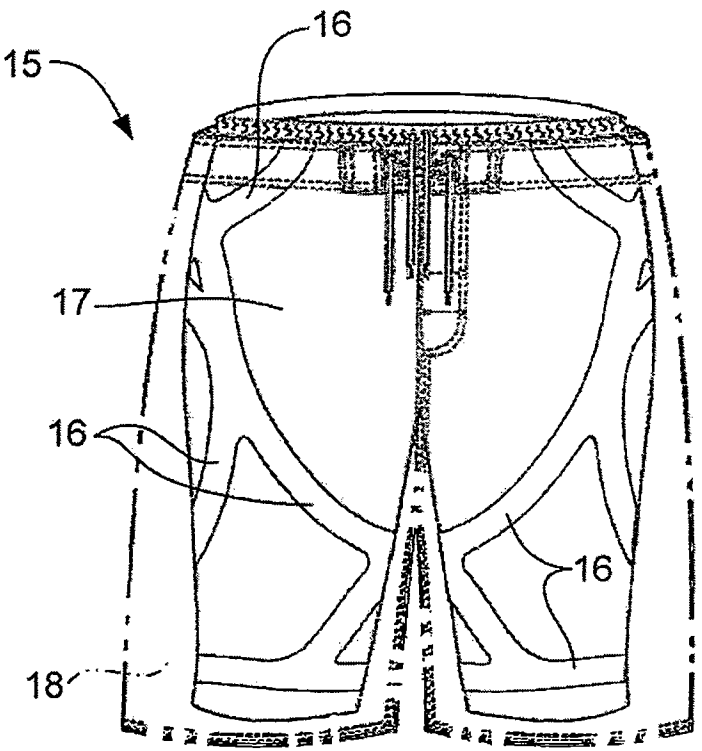

In FIG. 2, the garment 15 is shown in front and back views and includes taping 16 applied to an inner short 17. An outer short 18 overlies the inner short 17.

Figure 3A:
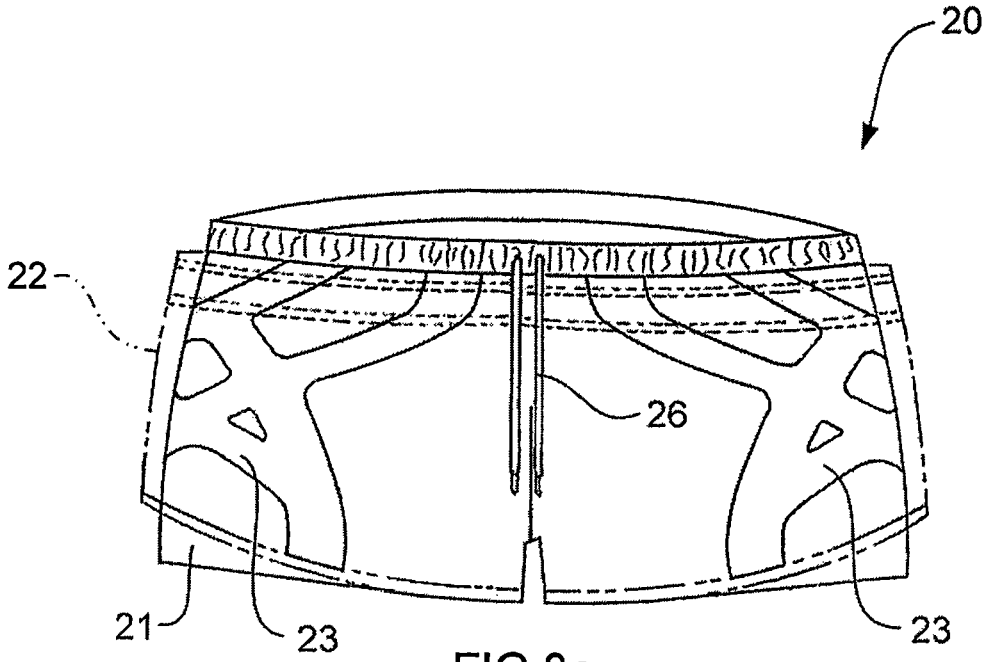
FIGS. 3 and 4 illustrate front and rear views of the technical pant boardshort garments of FIGS. 1 and 2 with details showing the functional effect on the wearer.
Figure 3B:
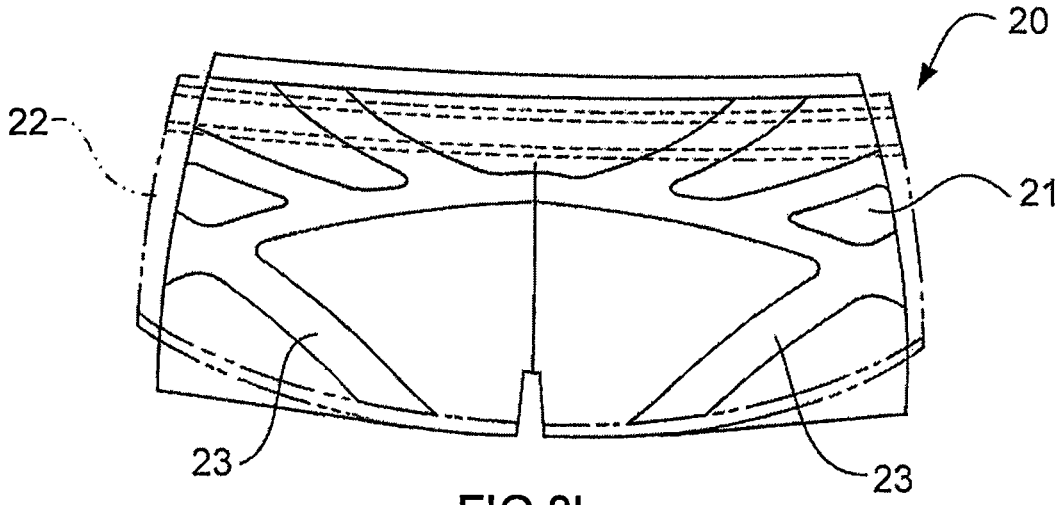

FIG. 3 shows an alternative boardshort 20, which has been designed principally for wearing by women. This contrasts with the FIGS. 1 and 2 embodiments which are designed principally for male use.

In FIG. 3, front and rear illustrations are made of a boardshort 20 which, like the boardshorts 10 and 15, includes an inner short 21 and an outer short 22. The major difference between the boardshorts 10 and 15, and the boardshort 20 is the length of the respective inner and outer shorts. It can be seen that in the boardshort 20, the length of the short is much less than the boardshorts 10 and 15, so that the boardshort 20 would not extend close to the knees of the wearer. Another difference between the boardshorts 10 and 15 and the boardshort 20, is in respect of the pattern of taping 23 which is applied to the boardshort 20. The taping 23 has been designed for the female anatomy and therefore is quite different to the design for the male anatomy.

Figure 4B:
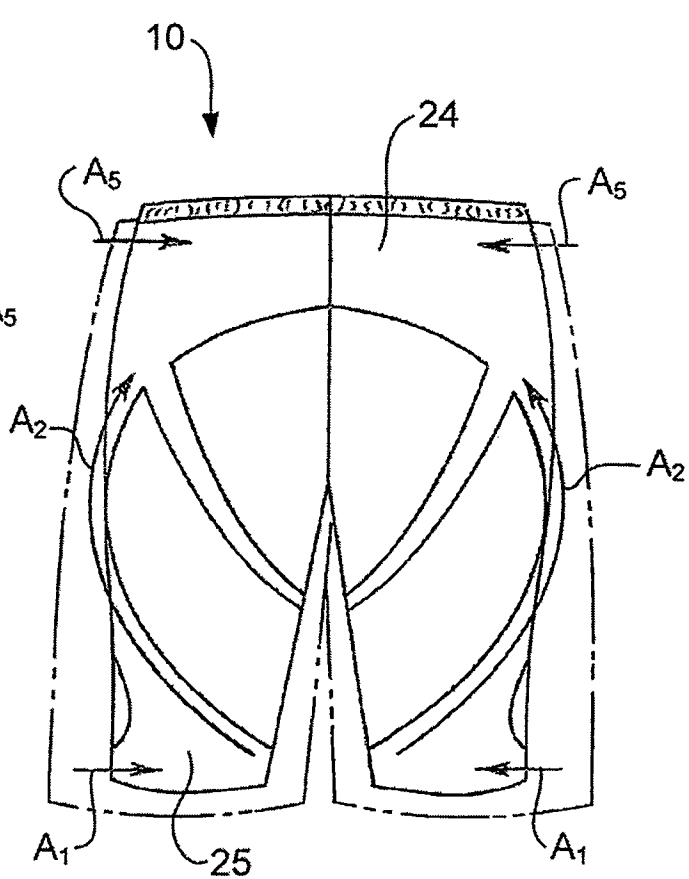
Figure 4A:
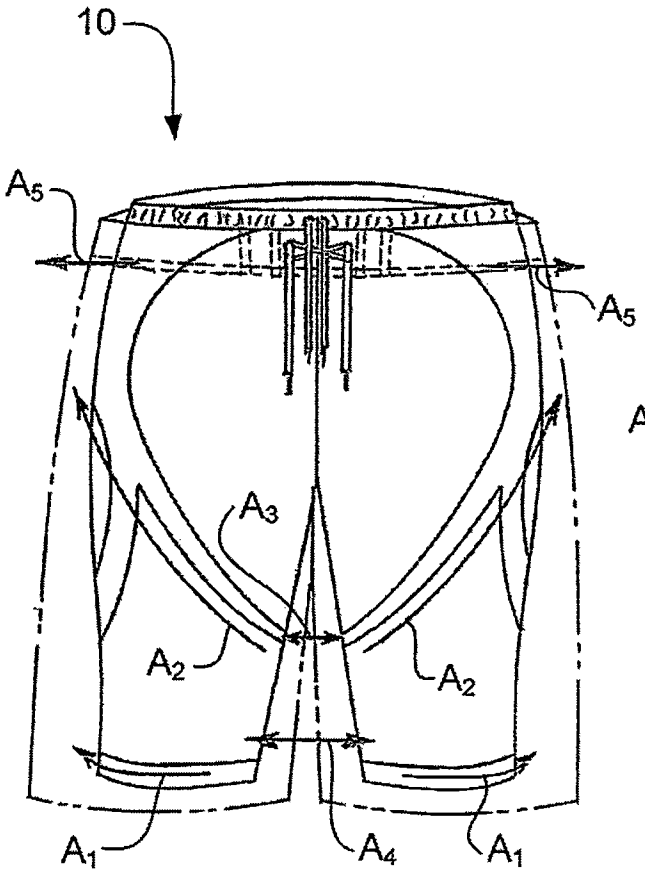

Referring now to FIG. 4, the boardshort 10 is illustrated according to FIG. 1, but in addition, various arrows show the direction in which the taping 13 "pulls" against the wearer's skin or muscles. With reference to the arrows $A_1$ and $A_2$, these loads tend to cause a wearer to increase the spacing between the thighs ($A_3$) and knees ($A_4$) which for a surfing stance is preferred. In addition, the pull which is in the direction $A_5$ tends to open up the hips/pelvis of the wearer which is also preferred for a surfing stance.

The arrows shown in the front view of FIG. 4 are shown extending through to the back view of FIG. 4 and this shows that the loads imposed by the taping 13 extend about the sides of the boardshort 10 and through to the back of the boardshort 10. The loads thus tend to pull around from the front to the back of the boardshort. In order to anchor the taping 13, the taping extends to anchor panels 24 and 25 on the back surface of the inner short 21.

Figure 5A:
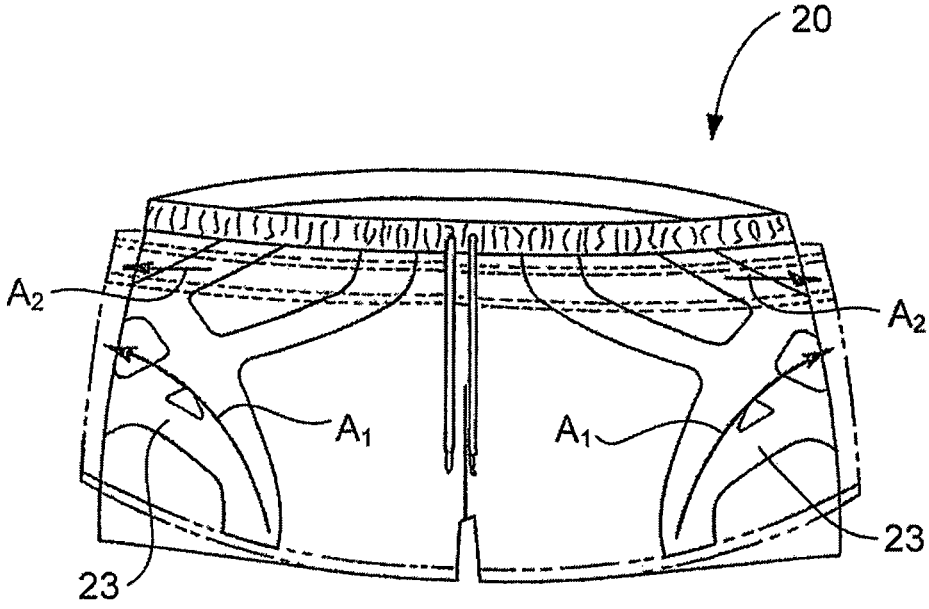
FIG. 5 illustrates front and rear views of a technical pant boardshort garment according to an embodiment of the invention.
Figure 5B:
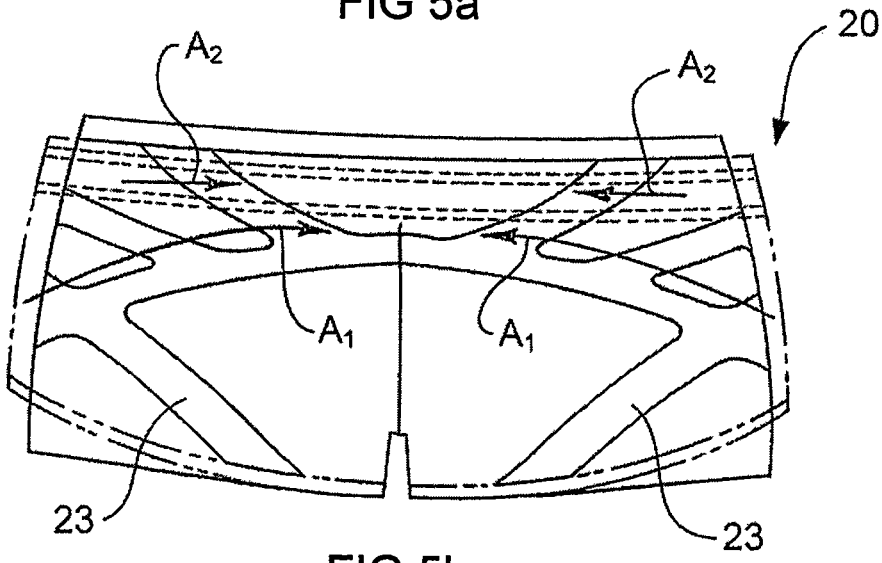

Referring to FIG. 5, the women's boardshort 20 is illustrated in back and front view, and again, the images include arrows $A_1$ and $A_2$ which show the pull loads applied by the taping 23. The arrows indicate that pull loads are applied in a direction to open the hips/pelvis of the wearer but there is no taping to open or separate the thighs and knees. This is due to the shorter length of the boardshort 20 as compared to the boardshort 10.

It will be appreciated that the taping and panels which are shown in FIGS. 1 to 5 are examples only of the type of taping and panels that can be employed. As indicated above, garments or boardshorts according to the invention can be customised to provide particular load characteristics. It may be that customisation is provided for single individuals, or groups of individuals, say of the same height or weight. In addition, it might be that certain levels of surfer could benefit from a particular style of boardshort in which certain loading is provided to move that surfing group to the next improved level of surfing. For example, complete beginners might commence surfing with one style of boardshort and as they improve, a different style of boardshort might be employed which has different load characteristics.

In addition, the boardshorts 10 and 20 which are illustrated schematically show the taping and panels applied to the respective boardshort. What is not illustrated is the manner in which the application of taping and panels takes place and as indicated earlier, this can be by adhesive, printing, stitching or other suitable attachment method. Moreover, the type of taping and panels, i.e. the materials they are made from can vary depending on the characteristics required.

Moreover, as discussed above, adhesive or tacky materials may be employed on the inner surface of the inner shorts 11 and 21, adjacent the taping applied to the inner short, so as to grip the wearer's skin in order for the pull loads applied to the wearer to be more effectively applied.

It would be evident from FIGS. 1 and 2 that the outer shorts 12 and 22 are a loose fit about the inner shorts 11 and 21. Connection between the inner and outer shorts 11 and 21 can be made by any suitable connecting mechanism, such as stitching or adhesive, but in some forms of the invention, a mesh, preferably a polyester mesh provides the connecting medium between the respective inner and outer shorts.

With reference to FIGS. 1 and 2, it can be seen that the respective inner shorts 11 and 21 extend slightly above the upper edge of the respective outer shorts 12 and 22. This occurs as a consequence of connecting the inner and outer shorts with a mesh fabric, while the benefit in making a connection of this kind is that the waist of the outer short can be a standard size larger than the waist of the inner short, so that the inner short can be a tight fit to the wearer and the outer short a loose fit. This maintains the preferred fashion look of the boardshorts 10 and 20, but still providing the benefit of the inner shorts 11 and 21. The use of mesh also facilitates flow of water through the gap between the inner short and the outer short, rather than preventing flow and capturing water.

The length of the mesh extending between the inner and outer shorts can be of any suitable dimension, such as in the region of 1 cm, while other fabrics apart from mesh could be used, such as a non-mesh elastic or non-elastic fabric.

Returning to FIGS. 1 and 2, it can be seen that the outer shorts 12 and 22 include drawer-string waist closures 26 and in respect of the boardshort 10, a fly region 27 is provided. These characteristics of the outer shorts 12 and 22 further liken the boardshorts 10 and 20 of the present invention to existing boardshorts which do not include an inner short.

Figure 7:
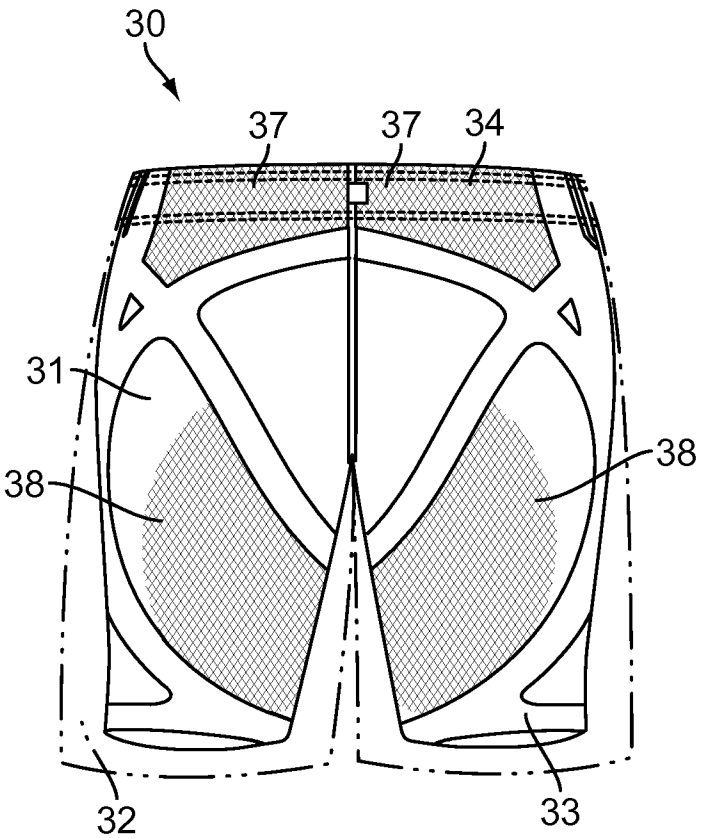
FIG. 7 illustrates a rear view of a technical pant boardshort garment according to an embodiment of the invention.
Figure 6:
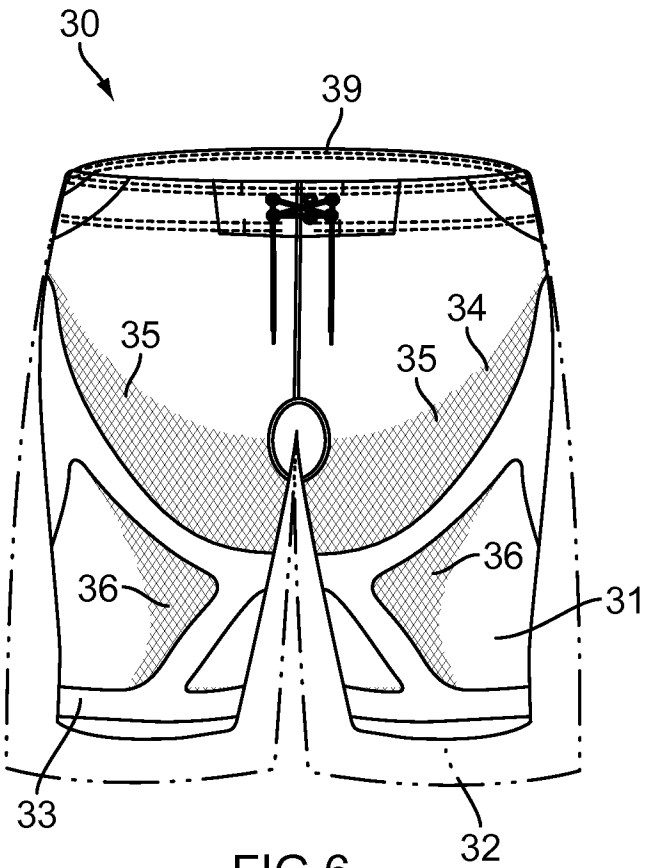
FIG. 6 illustrates a front view of a technical pant boardshort garment according to an embodiment of the invention.

Referring now to FIGS. 6 and 7, a technical pant garment 30 is shown in front and back views respectively. The garment 30 is of similar configuration to the garments illustrated in FIGS. 1, 2 and 4, in that it includes an inner short 31 and an outer short 32. Likewise, the inner short 31 of the garment 30 includes taping 33 which has similarities to the taping of FIGS. 1, 2 and 4, although the actual pattern of taping is slightly different.

The garment 30 also includes taping 34 which is formed in a matrix, grid or chequered pattern, to extend across sections of the inner short 31 on both the front and rear sides thereof. Thus, the taping 34 comprises sections 35 and 36 on the front of the inner short 31, and sections 37 and 38 on the rear side. The sections 35 to 38 are formed in the same matrix or grid pattern, although that is not essential. The respective sections 35 to 38 could be formed from grid or matrix patterns of the same or different dimensions or of different shapes to each other as required.

The taping of the sections 35 to 38 is applied to the inside surface of the inner short 31, although it could be applied to the outside surface of the inner short 31, or to both surfaces.

With the taping 34 of the sections 35 to 38 applied to the inside surface of the inner short 31, those sections 35 to 38 can grip the skin of the wearer across a broad surface, so as to securely anchor the inner short in place against the wearer's skin. The taping 34 of the sections 35 to 38 can be manufactured from the same material as the taping 33 and can be applied in the same manner. It is envisaged that the taping 33 and 34 will be a thermoplastic elastomer, a polymer material, such as a rubber or silicon, which is applied by heat fusion. Alternatively, the taping 33 and 34 can be of different materials of the kind described earlier herein.

The taping 34 can be applied more broadly to the inner short 31 than shown in FIGS. 6 and 7, in order to provide a greater area of grip to the wearer's skin. However, testing to date has shown that the position of taping and the extent of that taping shown in FIGS. 6 and 7 provide a good level of grip so that the placement of taping in other sections of the inner short 31 is not considered necessary.

The sections 35 to 38 typically grip the wearer's skin so that the inner short 31 is securely located in place against the wearer. By this arrangement, the taping 33 remains in place against the wearer's skin as intended during wearing of the garment 30 and it is not the taping 33 that is required to hold the inner short 31 in the correct position. Of course the taping 33 can contribute to maintaining the position of the inner short 31 in place against the wearer's skin and in some applications of the invention, the taping 33 can be applied without the taping 34 and the inner short will be maintained against the wearer's skin in an acceptable position. However, the addition of the taping 34 can more securely fix the inner short 31 against unwanted movement.

The sections 35 to 38 can also apply loading to the wearer's skin in order to affect the posture of the wearer in a manner tending to cause the wearer who has adopted an incorrect posture to realign towards a correct posture, although the major loads provided for that purpose in the illustrated embodiment are intended to be imposed by the taping 33.

The matrix or grid-like pattern of the taping 34 allows the inner short 31 to stretch and contract by stretching and contraction of the matrix or grid-like structure of the taping 34, but without actual shifting movement of the inner short 31 on the skin of the wearer.

This is highly advantageous as allowing for flexing of muscles and stretching of skin without repositioning of the inner short 31 on the wearer's waist and legs. The anchoring effect of the taping 34 assists to maintain the taping 33 in the intended position as adopted by the wearer when the garment 30 is first fitted to the wearer. Without the anchoring effect of the sections 35 to 38, the garment 39 would rely on the taping 33 gripping the wearer's skin and while the tape 33 can be selected to be of a suitable material and be applied in such a way that that will occur, the position of the taping 34 of the sections 35 to 38 enhances that effect.

While not particularly evident from FIGS. 6 and 7, the inner short 31 includes an elasticised waist 39, which again assists to maintain the inner short 31 in the intended position against the skin of the wearer. The portion of the outer short 32 adjacent the elasticised waist 39 can be non-elastic, and can thus have an appearance of prior art boardshorts, which typically have a non-elastic waist. However prior art boardshorts of that kind tend to have significant movement of the boardshort relative to the body of the wearer which is undesirable, and therefore provision of the inner short 31 of the invention with an elasticised waist 39 and attaching the outer short 32 to the inner short 31 tends to position the garment 30 more securely. Moreover, that better positioning can be provided without affecting the appearance of the boardshort as compared to prior art boardshorts.

The taping 34 extends into contact with the taping 33. That is, the taping 34 bridges between sections of the taping 33, so that the respective sections of taping 33 and 34 meet. In alternative embodiments the respective taping 33 and 34 do not meet and are therefore not in contact. In the illustrated embodiment of FIGS. 6 and 7, the taping 33 can overly the taping 34. Thus, the taping 34 can be applied first to the surface of the inner short and the taping 33 can then be applied over the taping 34.

The invention described herein is susceptible to variations, modifications and/or additions other than those specifically described and it is to be understood that the invention includes all such variations, modifications and/or additions which fall within the spirit and scope of the present disclosure.

Future patent applications may be filed in Australia or overseas on the basis of or claiming priority from the present application. It is to be understood that the following claims are provided by way of example only, and are not intended to limit the scope of what may be claimed in any such future applications. Features may be added to or omitted from the provisional claims at a later date so as to further define or re-define the invention or inventions.

What is claimed is:

1. A technical pant garment comprising:

an inner short being formed to fit tightly to the wearer of the garment and including a leg for entirely encircling a thigh of the wearer, the leg including a leg end and a portion for covering the front of the wearer's thigh, a portion for covering the wearer's inner thigh, and a portion for covering the wearer's outer thigh, the portion of the leg for covering the front of the wearer's thigh including an inner surface for facing towards and contacting the wearer's thigh and an outer surface for facing opposite the inner surface and away from the wearer's thigh, the inner short including one or more sections of elongate taping for imposing one or more loads on the wearer which act to affect the posture of the wearer in a manner tending to cause a wearer who has adopted an incorrect posture to realign towards a correct posture, one of the one or more sections of elongate taping having a width and extending on the leg of the inner short in a direction from the portion of the leg for covering the wearer's inner thigh to the portion of the leg for covering the wearer's outer thigh and then extending in a direction on the inner short away from the leg end, the inner short including sections of taping each having a width less than the width of the section extending on the leg of the inner short, and being arranged in a repeating pattern that forms the shape of a matrix, grid, or chequer on the inner surface of the portion of the leg for covering the front of the wearer's thigh for providing an area of grip for gripping the thigh of the wearer; and an outer short connected to the inner short and fitting loosely about the inner short and including a leg entirely encircling the leg of the inner short.

2. A garment according to claim 1, wherein the one or more sections of elongate taping are positioned to impose one or more loads on the wearer which act to resist movement of the wearer in certain directions.

3. A garment according to claim 1, wherein the one or more sections of elongate taping are positioned to push or pull against the skin of the wearer to impose one or more loads on the wearer so as to tend to cause the wearer to shift, move or realign from an incorrect posture towards a correct posture for the activity that is being undertaken.

4. A garment according to claim 1, wherein the one or more sections of elongate taping are constructed such that the one or more loads are applied continuously so that there is a constant load tending to cause the wearer to align towards a correct posture.

5. A garment according to claim 1, wherein the inner short includes an inner surface for facing towards and contacting the wearer's body and an outer surface for facing opposite the inner surface of the inner short and away from the wearer's body, and the one or more sections of elongate taping are applied to the inner surface of the inner short.

6. A garment according to claim 1, wherein the one or more sections of elongate taping are of variable stiffness to vary the load applied to the wearer.

7. A garment according to claim 1, wherein the one or more sections of elongate taping are affixed to the inner short by adhesive, or by stitching/sewing, or by printing, or by heat fusion.

8. A garment according to claim 1, wherein the inner short includes an inner surface for facing towards and contacting the wearer's body and an outer surface for facing opposite the inner surface of the inner short and away from the wearer's body, and the one or more sections of elongate taping are applied to the inner surface of the inner short and are of a material that tends to grip the skin of the wearer.

9. A garment according to claim 1, wherein the elongate taping of the inner short includes a plurality of sections of the elongate taping that intersect.

10. A garment according to claim 1, wherein the section extending on the leg of the inner short is curved.

11. A garment according to claim 10, wherein the elongate taping of the inner short further includes one or more sections of elongate taping that extend laterally to the section extending on the leg of the inner short.

12. A garment according to claim 1, wherein the sections of taping arranged in the repeating pattern on the portion of the leg for covering the front of the wearer's thigh are configured to apply a load tending to cause a wearer who has adopted an incorrect posture to realign towards a correct posture.

13. A garment according to claim 1, wherein the inner short is a compression short for applying muscle compression to the wearer of the garment.

14. Boardshorts comprising:

an inner short being formed to fit tightly to the wearer of the boardshorts and including a leg for encircling a thigh of the wearer, the leg including a leg end and an inner surface for facing towards and contacting the wearer's thigh and an outer surface for facing opposite the inner surface and away from the wearer's thigh, the inner short including sections of elongate taping for imposing one or more loads on the wearer which act to resist movement of the wearer in certain directions, the sections including a first section of the elongate taping forming a ring about the leg end of the leg and a second section of the elongate taping connected to and extending away from the first section in a direction towards a portion of the inner short for covering one of the wearer's hips, the inner short including sections of taping each having a width less than the width of the first section and less than the width of the second section and extending on the leg of the inner short, and being arranged in a repeating pattern that forms the shape of a matrix, grid, or chequer on a portion of the inner surface of the leg for covering the front of the wearer's thigh to provide an area of grip for gripping the thigh of the wearer; and an outer short connected to the inner short and fitting loosely around the inner short.

15. Boardshorts according to claim 14, wherein the first section and the second section act to resist movement of one of the wearer's knees towards the other knee.

16. Boardshorts according to claim 14, wherein an outer surface of the outer short is made from a water repellent material.

17. A technical pant garment comprising:

an inner short formed to fit tightly to the wearer of the garment and including:

a left leg for encircling a left thigh of the wearer and including an inner surface for facing towards and contacting the front of the wearer's left thigh and an outer surface for facing opposite the inner surface and away from the front of the wearer's left thigh, a right leg for encircling a right thigh of the wearer and including an inner surface for facing towards and contacting the front of the wearer's right thigh and an outer surface for facing opposite the inner surface and away from the front of the wearer's right thigh, sections of elongate taping for imposing one or more loads on the wearer which act to resist movement of the wearer in certain directions, the sections including a first section of the elongate taping having a width and being configured to extend on the left leg in a direction from the wearer's inner left thigh to the outer left thigh, and a second section of the elongate taping having a width and being configured to extend on the right leg in a direction from the wearer's inner right thigh to the outer right thigh, and sections of taping being arranged in a repeating pattern that forms the shape of a matrix, grid, or chequer on the inner surface of the left leg to provide an area of grip for gripping the front of the wearer's left thigh, and being arranged in a repeating pattern that forms the shape of a matrix, grid, or chequer on the inner surface of the right leg to provide an area of grip for gripping the front of the wearer's right thigh, the sections of taping arranged in the repeating pattern on the left leg and the right leg each having a width that is less than the width of the first section and less than the width of the second section; and an outer short being connected to the inner short and fitting loosely around the inner short.

18. A garment according to claim 17, wherein the sections of taping arranged in the repeating pattern on the left leg contact the first section, and the sections of taping arranged in the repeating pattern on the right leg contact the second section.

19. A garment according to claim 17, wherein the inner short includes an inner surface for facing towards and contacting the wearer's body and an outer surface for facing opposite the inner surface of the inner short and away from the wearer's body; and the garment further comprises sections of taping being arranged in a repeating pattern that forms the shape of a matrix, grid, or chequer on portions of the inner surface of the inner short for covering the backs of the thighs of the wearer to provide an area of grip for gripping the backs of the wearer's thighs, and sections of taping formed in a repeating pattern that form the shape of a matrix, grid, or chequer on a portion of the inner surface of the inner short for covering the lower back of the wearer to provide an area of grip for gripping the wearer's lower back, the sections of tapping arranged in the repeating pattern on the backs of the wearer's thighs and the wearer's lower back each having a width that is less than the width of the first section and less than the width of the second section.

20. A garment according to claim 17, wherein an outer surface of the outer short is made from a water repellent material.

* * * * *